US007698874B2

(12) United States Patent
Lörsch

(10) Patent No.: US 7,698,874 B2
(45) Date of Patent: Apr. 20, 2010

(54) APPARATUS AND METHOD FOR MAKING GAS-FILLED FILLING BODIES

(76) Inventor: Johannes Lörsch, An der Bleiche 49, 47638 Straelen (DE)

( * ) Notice: Subject to any disclaimer, the term of this patent is extended or adjusted under 35 U.S.C. 154(b) by 0 days.

(21) Appl. No.: 11/861,713

(22) Filed: Sep. 26, 2007

(65) Prior Publication Data

US 2008/0222998 A1 Sep. 18, 2008

Related U.S. Application Data

(60) Provisional application No. 60/956,284, filed on Aug. 16, 2007.

(30) Foreign Application Priority Data

Sep. 26, 2006 (DE) ..... 10 2006 045 793
Aug. 2, 2007 (EP) ..... 07113747

(51) Int. Cl.
*B65B 31/00* (2006.01)

(52) U.S. Cl. ..... 53/403; 53/79

(58) Field of Classification Search ..... 53/403, 53/432, 79, 512

See application file for complete search history.

(56) References Cited

U.S. PATENT DOCUMENTS 5,581,983 A * 12/1996 Murakami ..... 53/79
5,660,662 A * 8/1997 Testone ..... 53/403
6,423,166 B1 * 7/2002 Simhaee ..... 53/403
6,598,373 B2 * 7/2003 Sperry et al. ..... 53/403
6,605,169 B2 * 8/2003 Perkins et al. ..... 53/403
6,651,406 B2 * 11/2003 Sperry et al. ..... 53/403
6,659,150 B1 * 12/2003 Perkins et al. ..... 53/79
6,804,933 B2 * 10/2004 Sperry et al. ..... 53/403
7,040,073 B2 * 5/2006 Perkins et al. ..... 53/403
2003/0163976 A1 * 9/2003 Perkins et al. ..... 53/403
2006/0086064 A1 * 4/2006 Wehrmann ..... 53/403
2006/0090421 A1 * 5/2006 Sperry et al. ..... 53/403
2006/0218879 A1 10/2006 Garceau et al.
2006/0218880 A1 * 10/2006 Sperry et al. ..... 53/403

FOREIGN PATENT DOCUMENTS

DE 203 15 643 2/2005
DE 203 15 643 U 2/2005
EP 1 707 347 A 10/2006
WO WO 98/40276 A 9/1998
WO WO 02/26589 4/2002

* cited by examiner

*Primary Examiner*—Louis K Huynh
(74) *Attorney, Agent, or Firm*—Henry M. Feiereisen; Ursula B. Day

(57) ABSTRACT

Apparatus for making gas-filled filling bodies includes a supply reel for storing a pre-fabricated half-tubular plastic film having an at least partially open border side and being divided into individual pockets by weld seams which extend transversally with respect to a transport direction of the plastic film. Positioned downstream of the reel and receiving the plastic film from the reel is a gas filling device for blowing air into the pockets. Positioned downstream of the gas filling device and receiving the plastic film from the gas filling device is a welding tool for welding the open border side of the plastic film for formation of closed filling bodies. The transport of the film through the apparatus is realized by a drive unit which applies a force upon the plastic film essentially downstream of the gas filling device, as viewed in the transport direction.

16 Claims, 3 Drawing Sheets

APPARATUS AND METHOD FOR MAKING GAS-FILLED FILLING BODIES

CROSS-REFERENCES TO RELATED APPLICATIONS

This application claims the benefit of prior filed U.S. provisional Application No. 60/956,284, filed Aug. 16, 2007, pursuant to 35 U.S.C. 119(e), the content of which is incorporated herein by reference in its entirety as if fully set forth herein.

This application also claims the priorities of German Patent Application, Serial No. 10 2006 045 793.5, filed Sep. 26, 2006, and European Patent Application 07113747.5, filed Aug. 2, 2007 pursuant to 35 U.S.C. 119(*a*)-(*d*), the contents of which are incorporated herein by reference in its entirety as if fully set forth herein.

BACKGROUND OF THE INVENTION

The present invention relates, in general, to an apparatus and method for making gas-filled filling bodies.

Nothing in the following discussion of the state of the art is to be construed as an admission of prior art.

Gas-filled-normally air-filled-filling bodies are increasingly used as filling material for transport of sensitive goods in particular. Compared to traditional filling materials for packaging purposes, like e.g. filling bodies of foamed plastic, gas-filled filling bodies can be produced, at the site where they are needed, from a half-tubular film mounted on a reel by "blowing up" the film so that the volume of the filling bodies increases by a multiple, typically at least by the factor 10 compared to the initial volume of the film reel. After use, air can easily be released again from the filling bodies so that the amount of waste is reduced, although recycling of the films is, of course, easily possible.

International publication no. WO 02/26589 A1 discloses a continuously operating filling apparatus for making such gas-filled filling bodies, wherein a pre-fabricated half-tubular film which is open on one side is moved past a gas filling device, deflected at an angle, and then welded under the action of a heated band of Teflon-coated steel via a welding runner. This apparatus is complex and requires substantial maintenance works as a result of the use of Teflon-coated steel.

German utility model no. DE 203 15 643 U discloses an apparatus for making gas-filled filling bodies, having a welding tool configured as welding runner which directly rests upon the film material. The half-tubular film is hereby transported by belts as well as guide wheels. The transport of film requires a fairly complex mechanism with several drive elements which must be precisely synchronized in order to prevent, at commencement of the filing operation, the half-tubular film, which still is made from upper and lower film portions loosely lying upon one another, from escaping the machine, or to prevent a crease formation between the upper and lower film portions, which would render an air-tight welding impossible. The respective drive devices with gear mechanisms are thus expensive, require relatively large installation space, and require a drive motor with relatively high power as a result of friction and gear losses.

It would therefore be desirable and advantageous to provide an improved apparatus and method for making gas-filled filling bodies to obviate prior art shortcomings.

SUMMARY OF THE INVENTION

According to one aspect of the present invention, an apparatus for making gas-filled filling bodies includes a supply reel for storing a pre-fabricated half-tubular plastic film having an at least partially open border side and being divided into individual pockets by weld seams which extend transversally with respect to a transport direction of the plastic film, a gas filling device positioned downstream of the supply reel and receiving the plastic film from the supply reel for blowing air into the pockets, a welding tool positioned downstream of the gas filling device and receiving the plastic film from the gas filling device for welding the open border side of the plastic film for formation of closed filling bodies, a drive unit for moving the plastic film in the transport direction, with the drive unit applying a force upon the plastic film essentially downstream of the gas filling device, as viewed in the transport direction.

The present invention resolves prior art shortcomings by simplifying the drive for the transport of the plastic film by positioning the drive unit in the transport direction downstream of the gas filling device.

According to another feature of the present invention, the drive unit may be positioned downstream of the welding tool for effecting a transport of the plastic film in the transport direction. As a consequence, there is no need for transport belts or the like, and the drive unit can be greatly simplified and operated at reduced driving power.

According to another feature of the present invention, a braking mechanism may be provided for decelerating an unwinding of the plastic film from the supply reel so that the plastic film is held taut between the supply reel and the drive unit. In this way, air is prevented from escaping the pockets during advance of the plastic film through the gas filling device and downstream thereof. Operation of the brake mechanism may be triggered automatically or by hand. As a result of the provision of the brake mechanism, the respectively detached upper and lower film portions bear upon the gas filling device and thus prevent release of air and thereby reduce air losses.

Escape of injected air can also be prevented by implementing the welding operation as close as possible following the injection of air so that certain residual leaks do not significantly affect the filling degree of the filling bodies. According to another feature of the present invention, the drive unit may hereby be constructed to include two electric motor driven rollers which abut one another in a circumferential region and are each provided with a friction layer, and between which a border area of the plastic film is guided, as the plastic film moves in the transport direction. Suitably, the two rollers are disposed in offset relationship in horizontal direction.

According to another feature of the present invention, an upper one of the rollers is positioned in transport direction of the plastic film offset behind the lower one of the rollers, with the lower roller spatially following immediately the gas filling device. As a result, the plastic film can be deflected slantingly downwards at an angle of about 20° to 50° with respect to an imaginary extension of the horizontal transport path following the gas filling operation. Such an angular guidance prevents a migration of the film away from the transport direction as a result of warping caused during the blowing operation or a creasing between upper and lower film portions that would complicate the welding process.

The offset disposition of the rollers also allows the lower roller to form an abutment for the welding tool. As a result, the welding tool can be arranged immediately adjacent the gas filling device so that leaks upstream of the welding operation are minimized. The moved roller as abutment also realizes a superior quality of the weld seam.

As the plastic half tube is driven at only one area, with this drive operating in a section where the upper and lower film portions have already been welded, a reliable transport can be attained without warping between upper and lower film portions so that problems relating to the precise synchronization of different drive elements can be eliminated beforehand.

According to another feature of the present invention, air can be blown out slantingly from the gas filling device to define an air stream which has a movement component in transport direction of the plastic film and a movement component transversally to the transport direction. In this way, air is also prevented from escaping, after the plastic film is filled with gas and prior to the welding process.

According to another aspect of the present invention, a method of making gas-filled filling bodies includes the steps of unwinding from a supply reel a pre-fabricated half-tubular plastic film, which has an at least partly open border side and is divided into individual pockets by weld seams, continuously moving the plastic film past a gas filling device for blowing air into the pockets of the plastic film, and moving the plastic film past a welding tool for welding the open border side of the plastic film in an air-tight manner, wherein a transport of the plastic film is effected by a drive unit which applies a force upon the plastic film in transport direction downstream of the gas filling device.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1A:
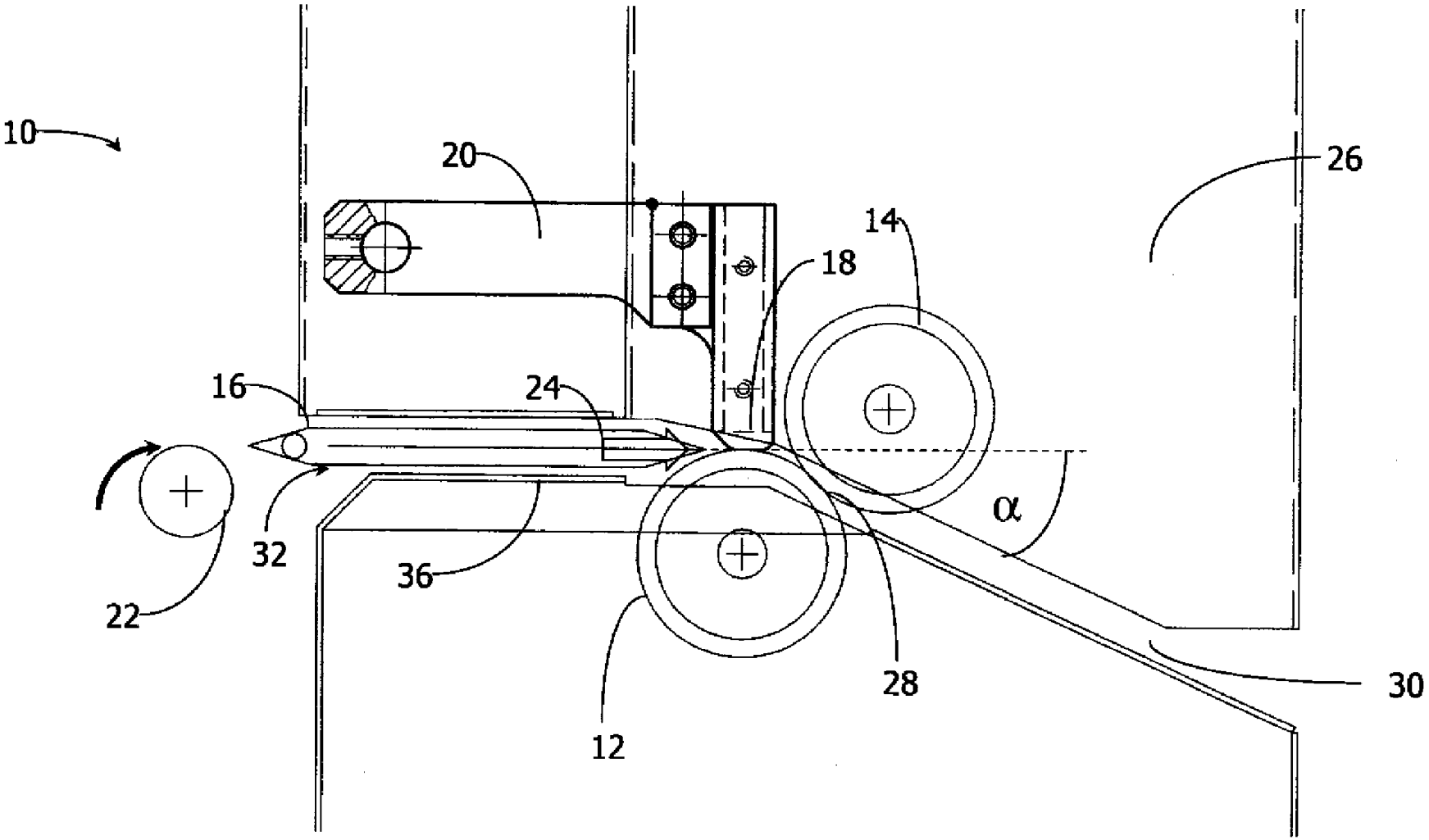
FIG. 1*a* shows a fragmentary schematic side view of an apparatus for making gas-filled bodies in accordance with the present invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 1B:
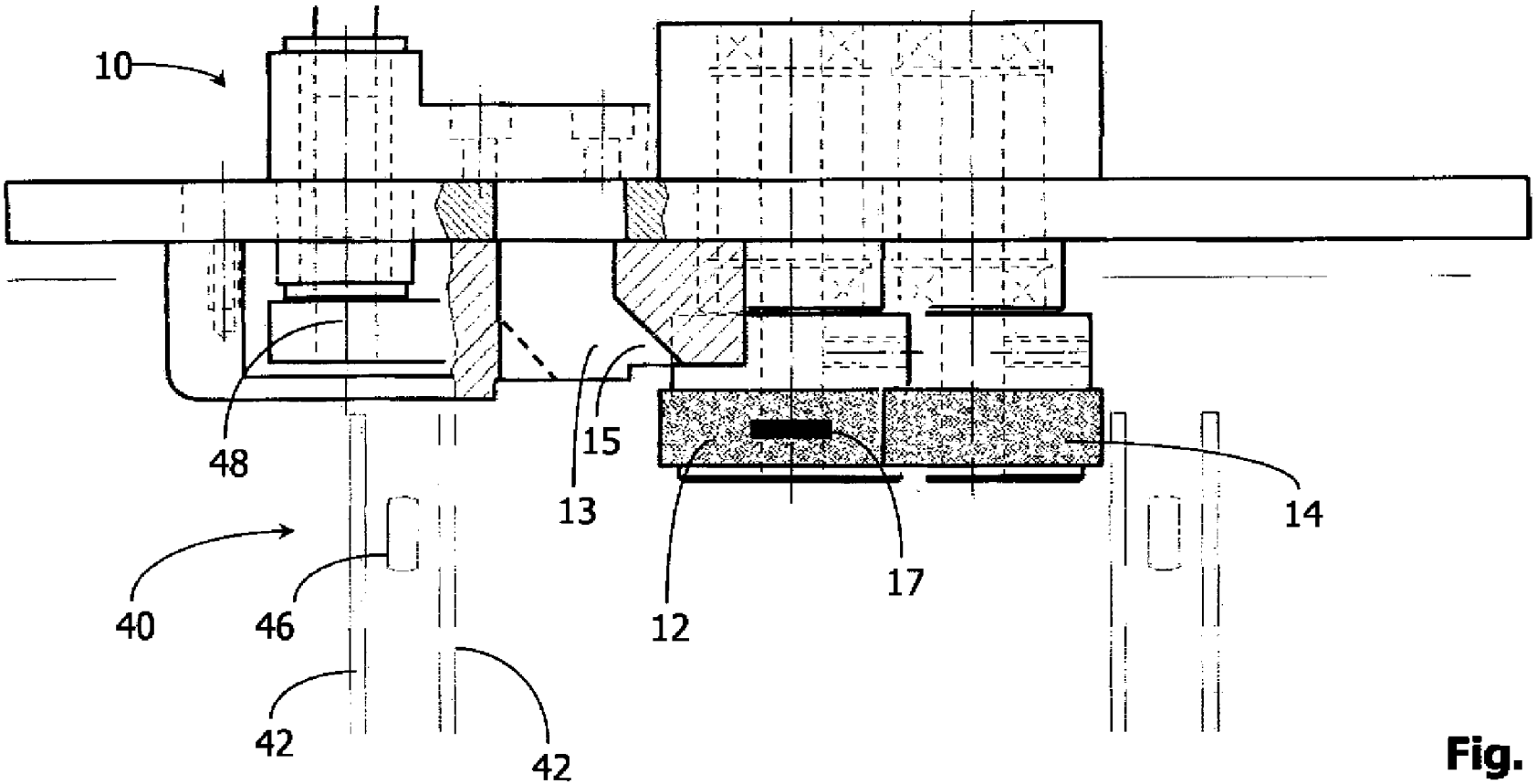
FIG. 1*b* is a plan view of the apparatus of FIG. 1*a;*

Turning now to the drawing, and in particular to FIG. 1*a*, there is shown a fragmentary schematic side view of an apparatus in accordance with the present invention, generally designated with reference numeral 10, for making gas-filled filling bodies from a half-tubular film 40 made of plastic. A specific construction of such a plastic film 40 is fully described in international publication no. WO 02/26589 A1, the entire specification and drawings of which are expressly incorporated herein by reference. It will be appreciated by persons skilled in the art that FIGS. 1*a*, 1*b* show only the relevant parts of the apparatus 10, namely a gas filling device 16 for injecting air, a welding tool 18 for welding, and a drive unit 12, 14 for transport of the film 40. Of course, the apparatus 10 contains much mechanical elements which do not appear in the foregoing figures. However, these elements are not part of the invention, and thus have been omitted from the figures for the sake of simplicity.

Figure 3:
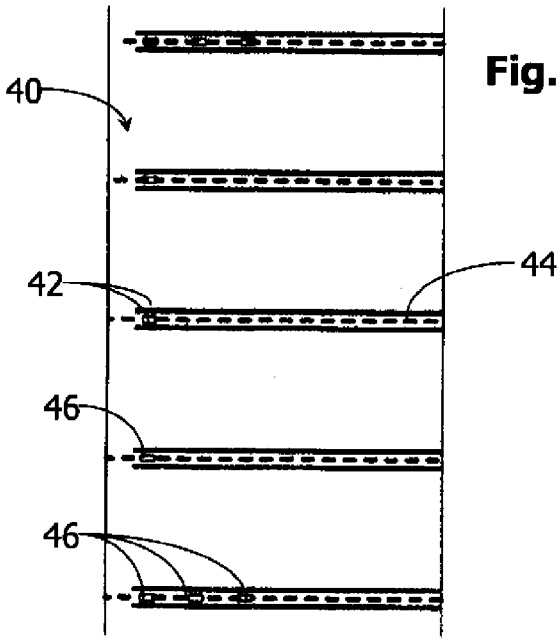
FIG. 3 is a portion of a plastic film in a flat state.
Figure 2:
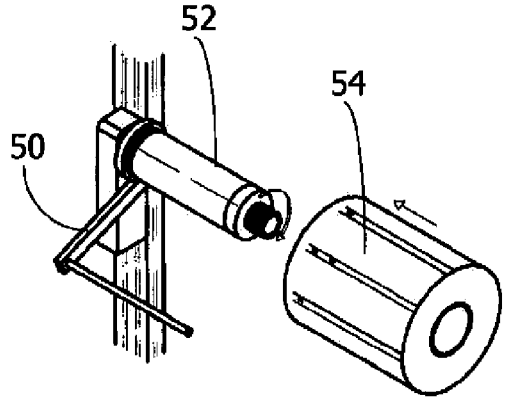
FIG. 2 is a perspective illustration, in exploded view, of a reel holder for attachment of a supply reel.
Figure 4:
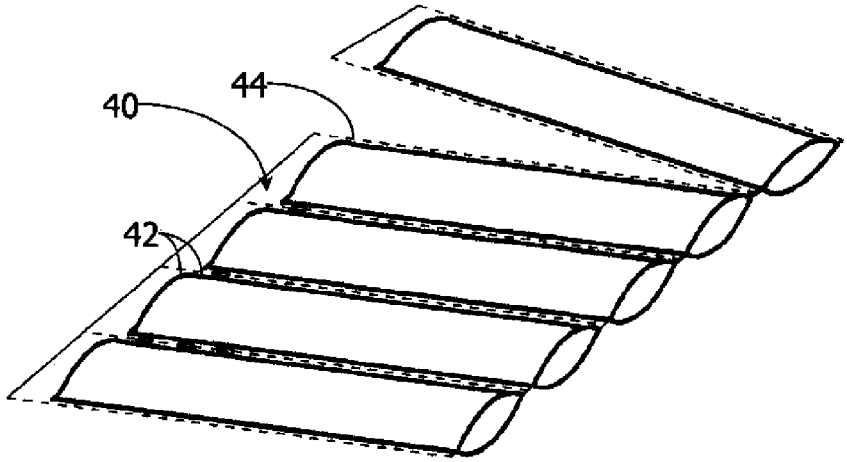
FIG. 4 is a portion of the plastic film in a filled state.

As shown in FIG. 3, the half-tubular film 40 has pairs of transverse weld seams 42 between which a perforation 44 is respectively provided. The transversal weld seams 42 end at a predefined distance from the open end of the half tube. Openings 46 in the intermediate space between the transversal weld seams 42 are provided for control of the apparatus 10, in particular for recognizing the position of the weld seams 42 or for control of the film welding operation in dependence on the film material, or the film materials when multilayered films are involved, or the film thickness. FIG. 3 shows the film 40 in a flat state when being rolled off a supply reel 54 (FIG. 2) for transport through the apparatus 10, whereas FIG. 4 shows the film 40 in a gas-filled state.

The film 40 is preferably made through co-extrusion of two layers, e.g. an outer layer of thermally stable plastic (e.g. melting temperature of about 120 to 130° C) in confronting relationship to a lighter meltable thinner inner layer (melting point, e.g., about 85° C). The welding properties are hereby greatly improved.

The film 40 is supplied from the supply reel 54 which can be locked in fixed rotative engagement with respect to a reel holder 52. Rotation of the reel holder 54 can be delayed by a brake mechanism whose strength can be automatically controlled by an engagement arm 50 over which the film 40 can be looped (not shown). By slowing down the unwinding operation of the film 40, as it is advanced through the apparatus 10, the film 40 is constantly transported under a defined tensile stress that keeps the film 40 taut.

The film 40 enters the apparatus 10 according to FIG. 1*a* from the left and is guided first by a freely running deflection roller 22 for movement in a feed direction marked by the arrow. The film 40 then reaches an entry slot 32 of the apparatus 10. The entry slot 32 is formed by guide plates and extends initially in a substantial horizontal direction. The entry slot 32 as well as an exit slot 30 on the opposite end of the apparatus 10 has a depth of few centimeters so that only the border area of the film tube 40 is guided in the slots 32, 30. The remaining area of the film tube 40, which typically has a width of approx. 20 cm, remains untouched by the slots 30, 32, but drags along a horizontal contact surface 36 so that filler pads can evolve unimpeded during gas filling, and the width of the filler pads can be flexibly selected.

A flat gas filling device 16 engages between the upper and lower film portions or layers, which are initially not interconnected along their margins, and has a wedge-shaped configuration on both ends for lifting the upper and lower film layers from one another and unite them again on the other end. An air passage 13, shown in FIG. 1*b*, extends in the illustration of FIG. 1*a* transversely to the drawing plane through the gas filling device 16 and is supplied with air by a fan which is arranged behind a base plate 26 and thus not visible in FIG. 1*a*. The air passage 13 extends slantingly or is configured in such a way that the exiting air flow has a movement component transversely to the drawing plane and in addition a component in movement direction of the film 40, as indicated by arrow 24. In this way, air losses in the area of the welding tool 18 can be additionally compensated.

The drive unit for transporting the film 40 includes two rollers 12, 14 which are driven in synchronism by an electromotive drive and provided with a rubber coating. The electromotive drive of the rollers 12, 14 is also provided behind the base plate 26 and thus not visible. One of the rollers, i.e. roller 12, engages the film 40 from below and is arranged adjacent to the gas filling device 16. This roller 12 serves also as abutment for the welding tool 18 which is pushed onto the topside of the film 40 and has a relatively small-area welding die to generate a weld seam of a width of typically about 2 to 3 mm.

The welding tool 18 is secured to a lever arm 20 which is supported by a support 48, shown in FIG. 1*b*, and is spring-biased against the film 40, when the welding tool 18 is operative, but is detached from the film 40, when assuming an idle state at standstill so as to avoid a melting of the film, whereby the lever arm 20 is swung by hand via an eccentric arrangement which activates the film advance at the same time via a not shown switch. The welding tool 18 is heated electrically via a heating cartridge and hereby held within a predefined temperature range by electronic control.

Provided in opposition to the roller 12 is the other roller 14 which is positioned offset to the rear in the transport direction of the film 40 and bears upon the roller 12 in a contact zone 28. As a result of the offset disposition of the roller 14 in relation to the roller 12, the film 40 is routed initially along a section of the circumference of the roller 12 and then guided slantingly downwards at an angle $\alpha$ of about 20° to 50° in relation to the horizontal between respective guide plates to the exit slot 30 where the filled gas bodies are discharged. The contact zone 28 between the rollers 12, 14 is thus located lower than the initial film transport plane. This angled disposition results in a proper guidance of the film 40 and in a proper weld seam formation. Also, the offset disposition of the roller 14 permits its use as abutment for the welding tool 18, so that the welding tool 18 can be arranged relatively closely to the gas filling device 16. As a result, air loss caused by leaks is minimized, with the air losses additionally reduced by the slanted air injection.

FIG. 1*b*, which is a basic view of the apparatus 10 along a section plane provided in the transport plane of the film 40, and not to scale, shows the position of the film 40 by way of broken line, respectively. The welding zone or contact surface of the welding tool 18 upon the roller 12 is designated by the area 17. FIG. 1*b* shows in particular a possible shape of the air passage 13, with a slant 15 deflecting an air flow also with a flow component in the direction of the welding zone 17. This configuration causes the air passage 13 to extend into the region of the circumference of the roller 12. As the upper and lower film layers lie substantially upon one another before being exposed to the welding tool 18, the illustrated configuration of the air passage 13 ensures optimum filling without leaks prior to the welding operation. It is also possible to slantingly guide the entire air passage 13 in the opening area, as indicated by the dashed line in the area of the air passage 13.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed is:

1. A method of making gas-filled filling bodies, comprising the steps of:

unwinding from a supply reel a pre-fabricated half-tubular plastic film, which has an at least partly open border side and is divided into individual pockets by weld seams;

blowing air laterally into the pockets of the plastic film as the plastic film moves continuously past a gas filling device in a substantially horizontal plane; and moving the plastic film past a welding tool for welding the open border side of the plastic film in an air-tight manner, wherein a transport of the plastic film is effected by a drive unit which applies a force upon the plastic film in transport direction solely downstream of the gas filling device and downstream of a site of application of the welding tool and has two electric motor driven rollers which abut one another in a circumferential region, with one of the rollers configured as an abutment for the welding tool, wherein each of the rollers defines a rotation axis, with the rotation axes of the rollers arranged behind one another in transport direction.

2. The method of claim 1, further comprising the step of subjecting the plastic film during a transport between the supply reel and the drive unit to a tensile stress to seal the open border side of the plastic film from a surrounding area during the blowing step by gas filling process and to effect in the transport direction that upper and lower film portions of the plastic film rest against the gas filling device.

3. Apparatus for making gas-filled filling bodies, comprising:

a supply reel for storing a pre-fabricated half-tubular plastic film having an at least partially open border side and being divided into individual pockets by weld seams which extend transversally with respect to a transport direction of the plastic film;

a gas filling device positioned downstream of the reel and receiving the plastic film from the reel for blowing air laterally through the open border side into the pockets;

a welding tool positioned downstream of the gas filling device and receiving the plastic film from the gas filling device for welding the open border side of the plastic film for formation of closed filling bodies; and a drive unit for moving the plastic film in the transport direction, said drive unit applying a force upon the plastic film solely essentially downstream of the gas filling device and downstream of a site of application of the welding tool, as viewed in the transport direction, wherein the drive unit has two electric motor driven rollers which abut one another in a circumferential region, and wherein the plastic film moves through the gas filling device in a substantially horizontal plane, with one of the rollers configured as an abutment for the welding tool, wherein each of the rollers defines a rotation axis, with the rotation axes of the rollers arranged behind one another in transport direction.

4. The apparatus of claim 3, wherein the site of application of the welding tool is at a location upstream of a site of force application by the drive unit for effecting a transport of the plastic film in the transport direction.

5. The apparatus of claim 3, wherein each of the rollers is provided with a friction layer, and wherein between the rollers a border area of the plastic film is guided, as the plastic film moves in the transport direction.

6. The apparatus of claim 3, wherein the gas filling device includes a flat passage configured to taper on both sides in transport direction, and further comprising a fan interacting with the gas filling device for blowing air into the flat passage, so that upper and lower film portions of the plastic film are initially detached from one another and then united.

7. The apparatus of claim 3, wherein the gas filling device is constructed to blow out air slantingly to define an air stream which has a movement component in transport direction of the plastic film and a movement component transversally to the transport direction.

8. The apparatus of claim 3, further comprising a braking mechanism for decelerating an unwinding of the plastic film from the supply reel so that the plastic film is held taut between the supply reel and the drive unit.

9. Apparatus for making gas-filled filling bodies, comprising:

a supply reel for storing a pre-fabricated half-tubular plastic film having an at least partially open border side and being divided into individual pockets by weld seams which extend transversally with respect to a transport direction of the plastic film;

a gas filling device positioned downstream of the reel and receiving the plastic film from the reel for blowing air laterally through the open border side into the pockets;

a welding tool positioned downstream of the gas filling device and receiving the plastic film from the gas filling device for welding the open border side of the plastic film for formation of closed filling bodies; and a drive unit for moving the plastic film in the transport direction, said drive unit applying a force upon the plastic film solely essentially downstream of the gas filling device and downstream of a site of application of the welding tool, as viewed in the transport direction, wherein the drive unit has two electric motor driven rollers which abut one another in a circumferential region, and wherein one of the rollers is arranged immediately downstream of the gas filling device and bears against a bottom side of the plastic film, and the other one of the rollers is arranged horizontally in the transport direction offset rearwardly with respect to the one roller for bearing against a topside of the plastic film and against the one roller so that the plastic film is guided in a downwardly bent direction at an angle with respect to an imaginary extension of the essentially horizontal transport direction, said welding tool bearing adjacent to the gas filling device against the topside of the border side of the plastic film, with the one roller acting as abutment for the welding tool.

10. The apparatus of claim 9, wherein the angle is about 20° to 50°.

11. The apparatus of claim 9, wherein the welding tool and the rotation axis of the one roller extend approximately vertically above one another.

12. The apparatus of claim 9, wherein the site of application of the welding tool is at a location upstream of a site of force application by the drive unit for effecting a transport of the plastic film in the transport direction.

13. The apparatus of claim 9, wherein each of the rollers is provided with a friction layer, and wherein between the rollers a border area of the plastic film is guided, as the plastic film moves in the transport direction.

14. The apparatus of claim 9, wherein the gas filling device includes a flat passage configured to taper on both sides in transport direction, and further comprising a fan interacting with the gas filling device for blowing air into the flat passage, so that upper and lower film portions of the plastic film are initially detached from one another and then united.

15. The apparatus of claim 9, wherein the gas filling device is constructed to blow out air slantingly to define an air stream which has a movement component in transport direction of the plastic film and a movement component transversally to the transport direction.

16. The apparatus of claim 9, further comprising a braking mechanism for decelerating an unwinding of the plastic film from the supply reel so that the plastic film is held taut between the supply reel and the drive unit.

* * * * *